United States Patent [19]

Eberhardt

[11] 3,955,117

[45] May 4, 1976

[54] OPTICAL PULSE DEMODULATOR

[75] Inventor: Edward H. Eberhardt, Fort Wayne, Ind.

[73] Assignee: International Telephone and Telegraph Corporation, Nutley, N.J.

[22] Filed: Jan. 30, 1975

[21] Appl. No.: 545,267

[52] U.S. Cl. ..... 315/11; 315/12 R; 329/108

[51] Int. Cl.[2] ..... H01J 31/48

[58] Field of Search ..... 329/108; 313/381, 95; 315/11, 12, 8.5

[56] References Cited

UNITED STATES PATENTS 3,333,145 7/1967 Nielsen ..... 315/10

*Primary Examiner*—Maynard R. Wilbur
*Assistant Examiner*—S. C. Buczinski
*Attorney, Agent, or Firm*—John T. O'Halloran; Menotti J. Lombardi, Jr.

[57] ABSTRACT

A fast scanning optical cathode ray tube with an array of electron multiplier output channels across the sweep path provides demodulation of short pulse code modulated optical signals. The cathode ray tube includes a photocathode, accelerating grid and fast sweep deflection electrodes to direct electron pulses successively across the plurality of output channels. The scanning is synchronized with the repetition rate and time of the incoming light pulses so that each channel accepts only pulses occurring during a particular time interval of the scan.

5 Claims, 1 Drawing Figure

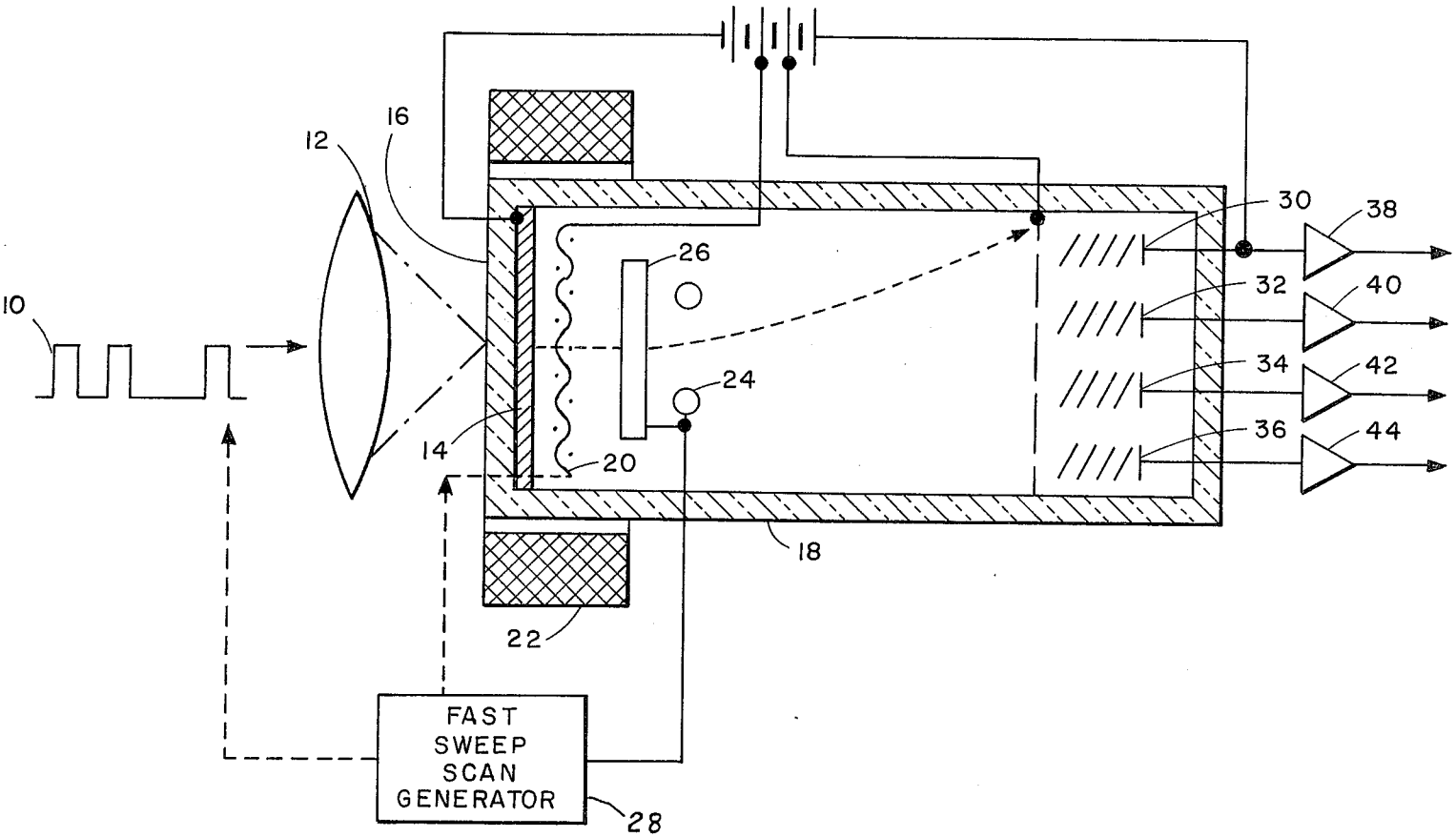
38
40
42
44
30
32
34
36
18
24
26
20
28
22
FAST
SWEEP
SCAN
GENERATOR
14
16
12
10

OPTICAL PULSE DEMODULATOR

BACKGROUND OF THE INVENTION

1. Field of the Invention

The present invention relates to optical demodulators and particularly to a novel optical cathode ray tube providing a plurality of electron multiplier demodulation channels.

2. Description of the Prior Art

Recent developments in optical communication systems have been directed to the use of pulse code modulation in conjunction with ultra-short pulse generators such as mode-locked lasers. Such systems provide good signal-to-noise ratios but require very high speed detectors which have not been readily available. It has previously been proposed to use a fast scanning optical cathode ray tube in conjunction with a smoothing image dissector for detection and analysis of individual short duration light pulses. This device is more fully described in U.S. Pat. No. 3,814,979, issued June 4, 1974, and assigned to the same assignee as the instant application. Image dissectors having a plurality of output electron multiplier channels are also known, such as shown in U.S. Pat. No. 3,333,145, issued July 25, 1967. Another type of cathode ray tube used for switching a plurality of output channels is described in the publication "IRE Transactions on Electron Devices," ED-9, pp. 11–15, dated November 1962, by R. Kalibjian. This device used an electron gun with an electrical input signal and required a very wide bandwidth and variable frequency scan.

SUMMARY OF THE INVENTION

It is therefore the primary object of the present invention to provide an improved optical demodulator capable of detecting very short pulse code modulated optical signals.

This is achieved with a novel combination of an optical cathode ray tube having an array of successively scanned electron multiplier output channels. A photocathode at one end converts incoming light pulses into electrons which pass through an accelerating grid and a pair of fast sweep narrow band deflection electrodes. The electron pulses are scanned in sequence across a linear or circular array of a plurality of electron multiplier channels. The scanning is synchronized with the repetition rate and time of the incoming pulses, with each channel spaced to automatically detect pulses occurring only during the associated time period to provide the desired demodulation. The invention will be more fully understood, and other objects and advantages will become apparent from the following description in conjunction with the accompanying drawing.

BRIEF DESCRIPTION OF THE DRAWING

The FIGURE schematically shows the optical demodulator of the present invention.

DESCRIPTION OF THE PREFERRED EMBODIMENTS

As shown in the FIGURE, a series of incoming pulse code modulated optical radiation pulses 10, having particular time related spacing between pulses, are received from a remote source of light signals such as a laser or light emitting diode. The pulses preferably have a fixed time relationship and repetition rate with detection being based on the presence or absence of pulses in the respective time period. Other types of pulse code modulation that may be accommodated include amplitude modulation of pulses within a constant time slot or varying the position of a narrow pulse to a small degree about a reference position within a longer fixed time interval.

The light pulses or photon bunches are directed through a lens 12 onto a photocathode electron emissive layer 14 on the faceplate 16 of an optical cathode ray tube 18. Electron bunches from the photocathode pass through a closely spaced high field gradient accelerating grid mesh 20 while maintaining picosecond ($10^{-12}$ sec.) time resolution and are focused into a corresponding beam by external magnetic focusing coils 22. Electrostatic focusing electrodes may also be employed. The beam passes through pairs of short horizontal and vertical electrostatic deflection plates 24, 26, which may be high frequency Lecher rods or wires that provide high speed scanning of the pulsed electron beam. The deflection rods are driven by a fast sweep scan generator 28 supplying a high voltage, fixed frequency, narrow band sinusoidally resonant sweep voltage which provides a time-synchronous circular or horizontal linear sweep at the pulse code modulation repetition rate. Spiral or raster scanning can provide a longer path for greater numbers of output channels. This rate may be in the order of from 1–10 nanoseconds ($10^{-9}$ sec.).

An array of electron multiplier channels 30, 32, 34, 36 is disposed along the sweep path to provide automatic detection according to the pulse code timing. Additional narrow bandwidth output amplifiers 38, 40, 42, 44 may be used in series with respective multiplier channels. The sweep phase across the aperture of each channel is synchronized with the pulse train so that output from each channel occurs only during the particular time interval of the associated pulse. The apertures are spaced so that the occurrence of each light pulse is coincident with the scanning of the respective aperture. Thus, channel 30 will detect all pulses in the first time slot, channel 32 detects pulses in the second time slot, and so forth, to maintain automatic time-slot demodulation.

Ten multipliers may be used to provide 10 time slots; for example, ten 100 ps. slots in a 1 ns, time interval, which would reduce the required circuit bandwidth by a factor of 10, or from 10 GHz to 1 GHz. Larger numbers of channels would further reduce the bandwidth for each. If many more time slots are needed, a microchannel plate type multiplier can be used having a pin plate output electrode, with only the pins in the particular sweep path being selectively energized. An added initial time slot can be used to maintain phase synchronization information between the pulse code modulated input pulses and the sweep drive circuits. Since the sweeps are resonant, accurate time synchronization can readily be achieved. Some variation of the aperture size can be made to accommodate other forms of pulse code modulation. In addition, if desired, automatic centering and sweep tracking circuits can be incorporated.

The present invention thus provides a novel high sensitivity optical cathode ray tube and system capable of demodulating pulse code modulated optical pulses of very short duration. While only a single embodiment is specifically illustrated and described, it is apparent that many variations may be made in the particular design and configuration without departing from the scope of the invention as set forth in the appended claims.

What is claimed is:

1. An optical pulse demodulator comprising:

a source of modulated optical radiation pulses having a given repetition rate and time relationship between pulses, an optical cathode ray tube having a transparent faceplate at one end, an electron emissive photocathode on the inner surface of said faceplate receiving said optical pulses and emitting corresponding electron pulses, a plurality of electron multiplier output channels positioned at the other end of said tube and spaced along a given path in correspondence with said time relationship between pulses, means for directing and focusing said electron pulses onto said output channels, deflection means for rapidly scanning said electron pulses across said plurality of output channels successively, and means applying a sweep signal to said deflection means, said sweep signal being synchronized with said repetition rate and time relationship of said pulses so that each of said plurality of pulses occurring during a given time interval is demodulated by a respective electron multiplier channel.

2. The device of claim 1 wherein said means for directing and focusing includes an accelerating mesh adjacent said photocathode, said deflection means including a pair of horizontal and vertical rods.

3. The device of claim 2 including focusing coils around said tube.

4. The device of claim 2 including lens means for directing said optical pulses onto said faceplate.

5. The device of claim 2 including output amplifier means connected in series with each said output channel.

* * * * *